US009341095B2

(12) United States Patent
Butler

(10) Patent No.: US 9,341,095 B2
(45) Date of Patent: May 17, 2016

(54) FREQUENCY-MODIFYING MUFFLER

(71) Applicant: Boyd L. Butler, Cottonwood Heights, UT (US)

(72) Inventor: Boyd L. Butler, Cottonwood Heights, UT (US)

( * ) Notice: Subject to any disclaimer, the term of this patent is extended or adjusted under 35 U.S.C. 154(b) by 0 days.

(21) Appl. No.: 14/301,332

(22) Filed: Jun. 10, 2014

(65) Prior Publication Data

US 2015/0014091 A1 Jan. 15, 2015

Related U.S. Application Data

(63) Continuation-in-part of application No. 13/603,295, filed on Sep. 4, 2012, now Pat. No. 8,746,401, which is a continuation-in-part of application No. 12/916,216, filed on Oct. 29, 2010, now Pat. No. 8,256,571.

(51) Int. Cl.
*F01N 1/08* (2006.01)
*F01N 13/08* (2010.01)

(52) U.S. Cl.
CPC *F01N 1/08* (2013.01); *F01N 1/083* (2013.01); *F01N 1/085* (2013.01); *F01N 13/08* (2013.01)

(58) Field of Classification Search
CPC ..... F01N 1/08; F01N 1/085; F01N 1/083; F01N 13/08; F01N 2470/30
USPC ..... 181/251, 253, 257, 264, 265, 266, 267, 181/268, 270, 275, 279, 280
See application file for complete search history.

(56) References Cited

U.S. PATENT DOCUMENTS

| | | | | |
|---|---|---|---|---|
| 5,739,483 | A * | 4/1998 | Yashiro et al. | 181/254 |
| 5,739,484 | A * | 4/1998 | Jones | 181/264 |
| 7,549,512 | B2 * | 6/2009 | Newberry | 181/281 |
| 2006/0054384 | A1 * | 3/2006 | Chen | 181/272 |

* cited by examiner

*Primary Examiner* — Jeremy Luks
(74) *Attorney, Agent, or Firm* — Thorpe North & Western, LLP

(57) ABSTRACT

A muffler for raising the audible pitch of an internal combustion engine's exhaust note that includes an enclosed case having an inlet and an outlet, and a plurality of flow-directing components which are adapted to subdivide an inlet flow into a plurality of discrete interior flows, including a first interior flow providing the shortest flow length through the muffler between the inlet and the outlet, a second interior flow having a flow length at least about twice the length of the first interior flow, and one or more intermediate flows following by-pass passages to split off from the second interior flow between the inlet and the outlet and having flow lengths between the flow lengths of the first and second flows.

7 Claims, 12 Drawing Sheets

FREQUENCY-MODIFYING MUFFLER

RELATED APPLICATIONS

This is a continuation-in-part of application Ser. No. 13/603,295 filed on Sep. 4, 2012, entitled Frequency-Modifying Muffler, now U.S. Pat. No. 8,746,401, which is a continuation-in-part of application Ser. No. 12/916,216 filed on Oct. 29, 2010, entitled Frequency-Modifying Muffler, now U.S. Pat. No. 8,256,571, both incorporated herein by reference.

FIELD OF THE INVENTION

The field of the invention relates generally to a sound-modifying device or muffler for internal combustion engines.

SUMMARY OF THE INVENTION

In accordance with the invention, a muffler for raising the audible pitch of an internal combustion engine's exhaust note includes an enclosed case having an inlet and an outlet, and a plurality of flow-directing components which are adapted to subdivide an inlet flow into a plurality of interior flows, including a first interior flow providing the shortest flow length through the muffler between the inlet and the outlet, a second interior flow having a flow length at least about twice the length of the first interior flow, and one or more intermediate flows following by-pass passages to split off from the second interior flow between the inlet and the outlet and having flow lengths between the flow lengths of the first and second flows.

In accordance with a representative embodiment of the invention described herein, a muffler is provided for raising the audible pitch of an internal combustion engine's exhaust note includes an enclosed case having an inlet in an inlet end and an outlet in an outlet end, and a plurality of flow-directing components which are adapted to subdivide an inlet flow into a plurality of interior flows, including a first interior flow following a substantially-direct passage between the inlet and the outlet, a second interior flow following a tortuous passage between the inlet and the outlet and having a length at least about twice a length of the substantially-direct passage, and one or more shortcut flows following by-pass passages to split off from the second interior flow between the inlet and the outlet.

In accordance with another representative embodiment described herein, the muffler includes an enclosed case having an inlet in an inlet end and an outlet in an outlet end, and a plurality of flow-directing components spanning a distance between a top and a bottom of the enclosed case and adapted to subdivide an inlet flow into a plurality of interior flows, wherein the flow-directing components comprise a flowtube extending between the inlet and the outlet to form a substantially-direct passage for a first interior flow, and at least two deflector plates oriented transverse to a longitudinal center axis of the case and supporting the flowtube therethrough. Adjacent deflector plates are laterally offset from the longitudinal center axis in opposite directions, with wide gaps between each deflector plate and alternating far sidewalls forming a tortuous passage between the inlet and the outlet for a second interior flow having a length at least about twice a length of the substantially-direct passage, and narrow gaps between the deflector plates and alternating near sidewalls form at least one by-pass passage for a shortcut flow splitting off from and recombining with the second interior flow between the inlet and the outlet.

In accordance with another representative embodiment described herein, the muffler includes an enclosed case having an inlet and an outlet, and at least one flow-directing component spanning a distance between a top and a bottom of the enclosed case to form parallel passages within the case along opposite sides of the at least one flow-directing component with the parallel passages being connected at an end of the flow-directing component. Flow is from the inlet along one side of the at least one flow-directing component, around an end of the at least one flow-directing component and back along the opposite side of the at least one flow directing component before reaching the outlet. Such parallel passages form a tortuous passage of greatest flow length within the case between the inlet and outlet. Openings through or around the at least one flow-directing component connect the parallel passages and by-pass portions of the parallel passages to form a passage of shortest flow length and to form at least one intermediate passage of length intermediate the longest and shortest length passages. In this way, inlet flow is subdivided into a plurality of interior flows, including a first interior flow providing the shortest flow length through the muffler between the inlet and the outlet, a second interior flow having a flow length at least about twice the length of the first interior flow, and one or more intermediate flows following by-pass passages to split off from the second interior flow between the inlet and the outlet and having flow lengths between the flow lengths of the first and second flows.

In accordance with another representative embodiment described herein, a method is provided for raising the audible pitch of an internal combustion engine's exhaust note. The method includes obtaining an enclosed case having an inlet and an outlet and having a plurality of flow-directing components adapted to subdivide an inlet flow. The method then divides the flow by directing a first interior flow through a first flow passage providing the shortest flow length between the inlet and the outlet, directing a second interior flow through a second flow passage having a flow length at least about twice the length of the first flow passage, and splitting off at least one intermediate flow from the second interior flow with at least one by-pass passage between the inlet and the outlet.

BRIEF DESCRIPTION OF THE DRAWINGS

Features and advantages of the present invention will be apparent from the detailed description that follows, and when taken in conjunction with the accompanying drawings together illustrate, by way of example, features of the invention. It will be readily appreciated that these drawings merely depict representative embodiments of the present invention and are not to be considered limiting of its scope, and that the components of the invention, as generally described and illustrated in the figures herein, could be arranged and designed in a variety of different configurations. Nonetheless, the present invention will be described and explained with additional specificity and detail through the use of the accompanying drawings, in which.

DETAILED DESCRIPTION OF EXEMPLARY EMBODIMENTS

Figure 1:
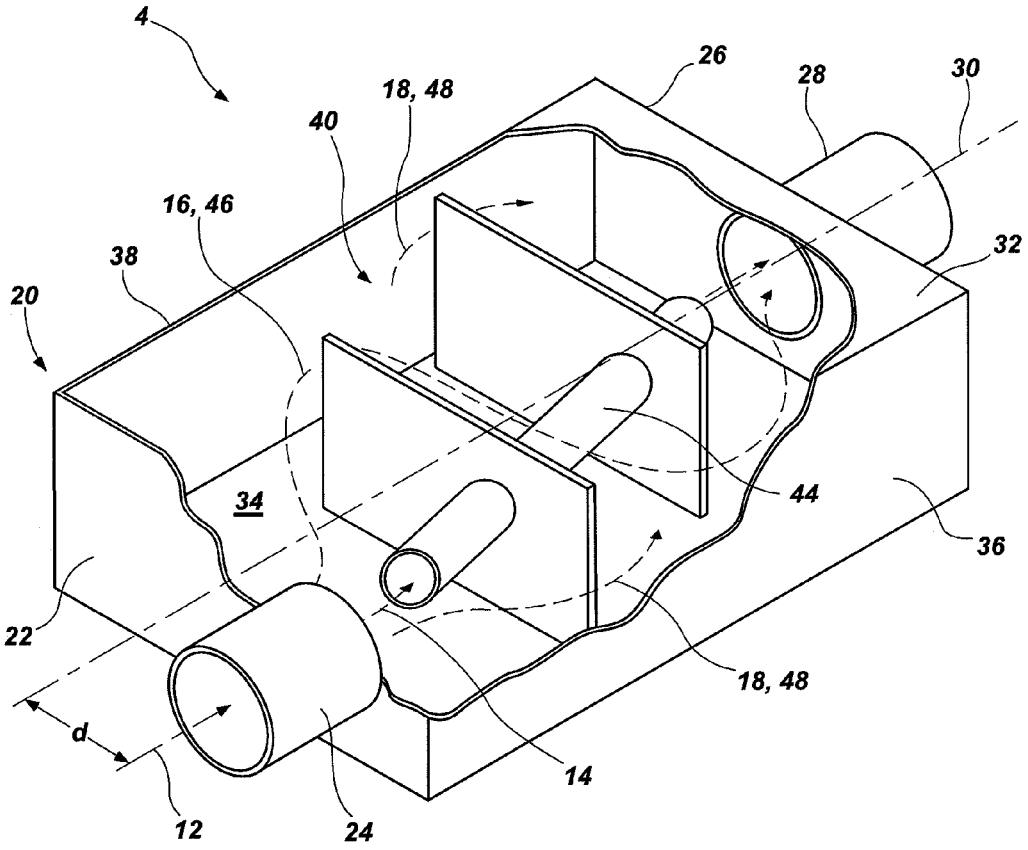
FIG. 1 illustrates a muffler for raising an audible pitch of an internal combustion engine's exhaust note, in accordance with one representative embodiment.

The following detailed description makes reference to the accompanying drawings, which form a part thereof and in which are shown, by way of illustration, various representative embodiments in which the invention can be practiced. While these embodiments are described in sufficient detail to enable those skilled in the art to practice the invention, it should be understood that other embodiments can be realized and that various changes can be made without departing from the spirit and scope of the present invention. As such, the following detailed description is not intended to limit the scope of the invention as it is claimed, but rather is presented for purposes of illustration, to describe the features and characteristics of the representative embodiments, and to sufficiently enable one skilled in the art to practice the invention. Accordingly, the scope of the present invention is to be defined solely by the appended claims.

Furthermore, the following detailed description and representative embodiments of the invention will best be understood with reference to the accompanying drawings, wherein the elements and features of the embodiments are designated by numerals throughout.

Definitions

In describing and claiming the present invention, the following terminology will be used.

The singular forms "a," "an," and "the" include plural references unless the context clearly dictates otherwise. Thus, for example, reference to "a deflector plate" includes reference to one or more of such structures, and "directing" refers to one or more of such steps.

As used herein, "longitudinal center axis" refers to the long axis or centerline axis of an enclosed case housing of the sound-modifying muffler As used herein, "substantially-parallel" refers to a direction that is parallel with a referenced plane or axis at an angle ranging from parallel to about 45 degrees off the referenced plane or axis.

As used herein, "transverse" refers to a direction that cuts across a referenced plane or axis at an angle ranging from perpendicular to about 45 degrees off the referenced plane or axis.

As used herein, "substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context. Similarly, "substantially free of" or the like refers to the lack of an identified element or agent in a composition. Particularly, elements that are identified as being "substantially free of" are either completely absent from the composition, or are included only in amounts which are small enough so as to have no measurable effect on the composition.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, and sub-ranges such as 10 to 50, 20 to 100, etc.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Embodiments of the Invention

Illustrated in FIGS. 1-24 are several representative embodiments of a sound-modifying muffler for raising the audible pitch of an internal combustion engine's exhaust note, which embodiments also include various methods for raising the pitch of the exhaust note. As described herein, the muffler provides several significant advantages and benefits over other devices and methods attenuating or modifying the sound emitted by an internal combustion engine. However, the recited advantages are not meant to be limiting in any way, as one skilled in the art will appreciate that other advantages may also be realized upon practicing the present invention.

FIG. 1 shows an exemplary embodiment of a sound-modifying muffler 4 for raising the audible pitch of an internal combustion engine's exhaust note. The muffler 4 includes an enclosed case 20 having an inlet 24 in an inlet end 22 and an outlet 28 in an outlet end 26, as well as a top 32, a bottom 34 and two sidewalls 36, 38 surrounding a longitudinal center axis 30. The inlet and outlet can be simple openings the inlet end plate 22 and outlet end plate 26, respectively, or can be tubular pipe stubs 24, 28 extending outwardly from the end plates 22, 26, as shown in FIG. 1, and configured to interconnect with the exhaust piping system of the internal combustion engine. In one aspect the longitudinal center axis 30 can be parallel to the centerline axes of the inlet 24 and outlet 28 in the inlet and outlet ends 22, 26 of the case, although one or both of the inlet and the outlet may be laterally offset from the longitudinal center axis 30 by a distance d, or may coincide with the longitudinal center axis 30 as shown for outlet 28.

A plurality of flow-directing components 40 can be located inside the case and adapted to subdivide an inlet flow 12 into a plurality of interior flows, including a first interior flow 14 following a substantially-direct passage 44 between the inlet 24 and the outlet 28, a second interior flow 16 following a tortuous passage 46 between the inlet and the outlet and having a length at least about twice the length of the substantially-direct passage 44, and one or more shortcut flows 18 following by-pass passages 48 as they split off from the second interior flow 16 between the inlet 24 and the outlet 28.

Figure 2:
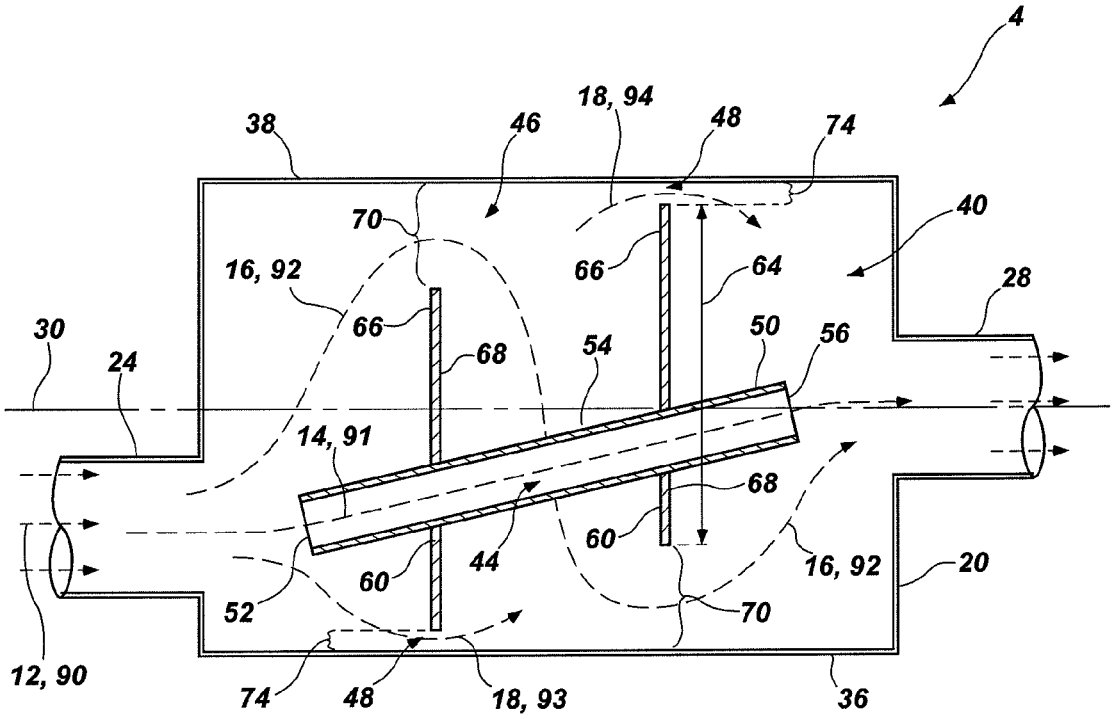
FIG. 2 is a top cross-sectional view of the muffler of FIG. 1, taken along section line 2-2.

As better viewed in the top cross-sectional view of FIG. 2, each of flow passages 44, 46, 48 can have a different and unique length between the inlet 24 and the outlet 28, so that each of the plurality of interior flows 14, 16, 18, that are subdivided from the inlet flow 12 are caused to traverse a different length as it travels from one end to the other of the enclosed case 20. For instance, the substantially-direct passage 44 can allow the first interior flow 14 to be the quickest interior flow to reach the outlet 28, while the tortuous passage 46 having a length at least about twice the length of the substantially-direct passage and can cause the second interior flow 16 to be the last interior flow to reach the outlet 28. Meanwhile, each of the shortcut flows 18 passing through the two by-pass passages 48 between the flow-directing components 40 and the sidewalls 36, 38 of the enclosed case can reach the outlet 28 opening sometime between the arrivals of the first interior flow 14 and the second interior flow 16.

In the embodiment shown, the plurality of flow-directing components 40 installed within the casing 20 can include a flowtube 50 extending between the inlet 24 and the outlet 28 to form the substantially-direct passage 44 for the first interior flow 14. The flowtube 50 can include a flowtube inlet 52, a flowtube outlet 56 and a tubular body 54, and can be supported by two or more deflector plates 60 having a height 62 (see FIG. 3) that spans the distance between the top 32 and the bottom 34 of the enclosed case 20. Moreover, the flowtube can be sized and configured so that about ⅙ or more of the inlet flow 12 is captured by the flowtube inlet 52 and passes into the tubular body 54 as the first interior flow 14.

Referring back to FIG. 2, the two or more deflector plates 60 can be oriented transverse to a longitudinal center axis 30 of the enclosed case 20, and can have a width 64 that is less than a width of the case, so that neither lateral side edge of the deflector plates contacts a sidewall 36, 38 of the enclosed case. Furthermore, any two adjacent deflector plates 60 can be laterally offset from the longitudinal center axis 30 in opposite directions from each other, with the wide gaps 70 between each deflector plate 60 and alternating far sidewalls (38, 36) forming the tortuous passage 46 for the second interior flow 16. Thus, the second interior flow 16 can be directed completely around each deflector plate after it enters through the inlet and is first turned and directed along the front face 66 a foremost deflector plate, around a lateral side edge of the deflector plate as it passes through a wide gap 70, and back across the back face 68 of the foremost deflector plate and the front face of an adjacent trailing deflector plate as it crosses the width of the enclosed case until it reaches the next wide gap 70 on the opposite side of the enclosed case 20.

As can also be seen in FIG. 2, in one aspect a by-pass passage 48 can be formed by the narrow gap 74 located between the foremost deflector plate 60 closest to the inlet 24 and the near sidewall 36, and which can allow a shortcut portion 18 of the second interior flow 16 to branch off from the second interior flow 16 and pass through the narrow gap 74 to recombine with the main portion of the second interior flow which traveled completely around the foremost deflector plate 60. The recombined flow can then travel through the second wide gap 70 between the subsequent deflector plate 60 and the sidewall 36 prior to reaching the outlet 28. Similarly, another by-pass passage 48 can be formed by the narrow gap 74 located between the subsequent deflector plate 60 nearest the outlet 28 and an alternating near sidewall 38, and which can allow another shortcut portion 18 to branch off from the second interior flow 16 and pass through the narrow gap 74 to recombine with the portion of the second interior flow which traveled completely around the subsequent deflector plate 60, and prior to reaching the outlet 28.

Thus, with the embodiment of the sound-modifying muffler 4 described and illustrated with reference to FIGS. 1-3, the shortcut flows 18 that branches off from the second interior flow 16 between the inlet 24 and the outlet 28 can subsequently recombine with the second interior flow 16 prior to reaching the outlet 28.

Figure 3:
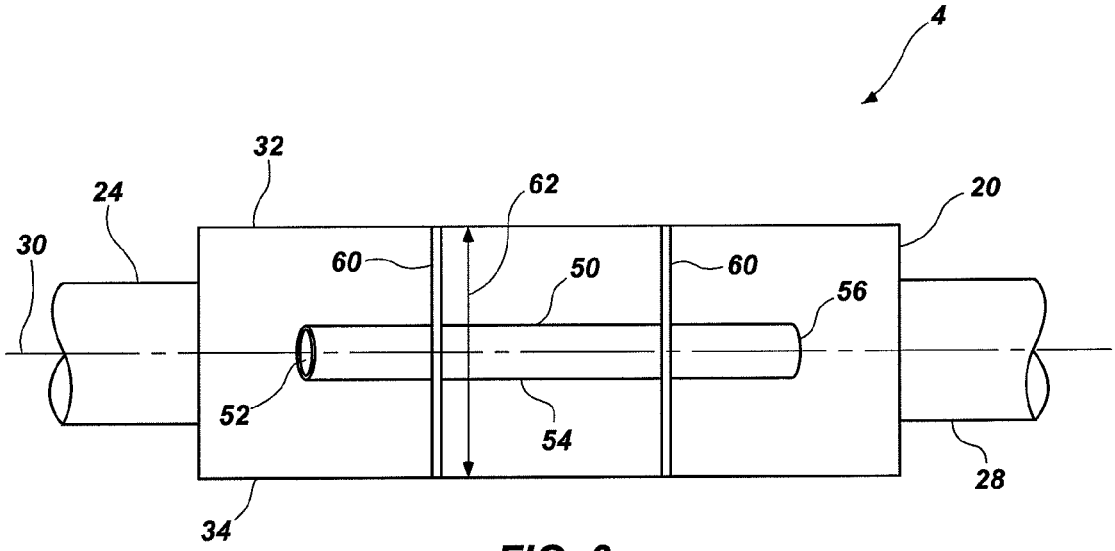
FIG. 3 is a side cross-sectional view of the muffler of FIG. 1, taken along section line 3-3.
Figure 6A:
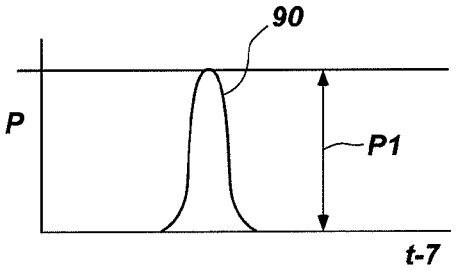
FIGS. 6A-6D together illustrate the breaking up of a single inlet exhaust pulse into a plurality of reduced-pressure outlet exhaust pulses, as provided by the mufflers of FIGS. 1, 4 and 5, respectively.
Figure 6B:
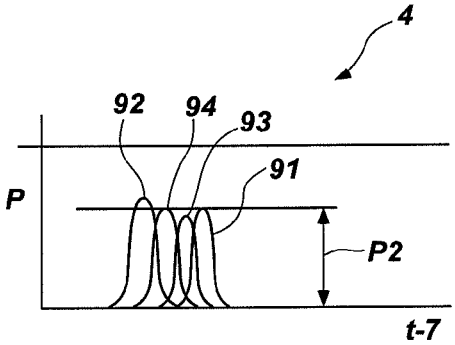

In the aspect of the sound-modifying muffler 4 having a single flowtube 50 and two deflector plates 60, as illustrated in FIGS. 1-3, the number of pathways for a pressure/sound pulse to travel through the muffler can generally correspond with the number of interior flow passages. For instance, as shown in FIGS. 2 and 6A, a single inlet pulse of exhaust gas 90 can be delivered to the inlet 24 of the sound-modifying muffler 4 from the exhaust port of a single cylinder of an internal combustion engine (not shown). Upon entrance into the enclosed case 20, the internal flow-directing components 40 can break up the single inlet exhaust pulse 90 into four internal exhaust pulses, namely one first exhaust pulse 91 traveling through the flowtube 44, one second exhaust pulse 92 traveling along the tortuous passage 46, and two short-cut exhaust pulses 93, 94 traveling through the two by-pass passages 48, all of which can recombine proximate to the outlet 28 as four reduced-pressure outlet exhaust pulses (see FIG. 6B), with each having a different phase spacing than the others due to the differences in the lengths of the various flow passages.

Figure 4:
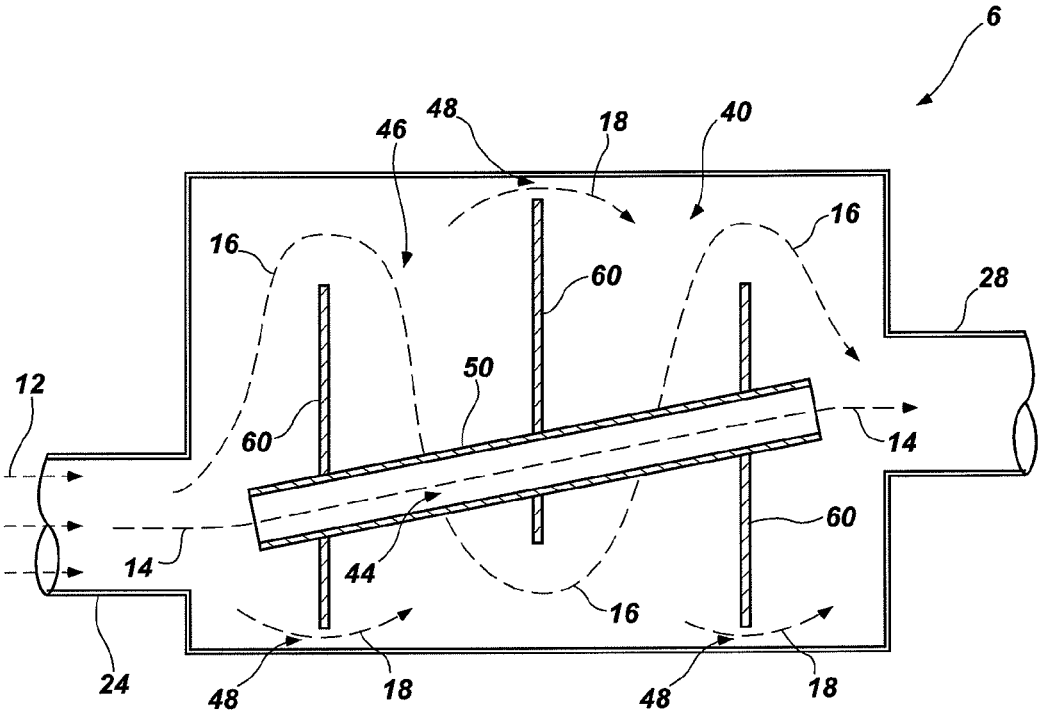
FIG. 4 is a top cross-sectional view of a muffler similar to that of FIG. 1 having three deflector plates, in accordance with another representative embodiment.

Referring now to FIG. 4, in another aspect, the sound-modifying muffler 6 can include a single flowtube 50 supported through three deflector plates 60, forming a plurality of flow-directing components 40 that are configured to provide one substantially-direct passage 44, one tortuous passage 46, and three by-pass passages 48, and which together can subdivide an inlet flow 12 into one first interior flow 14, one second interior flow 16, and three shortcut flows 18, respectively. As further shown in FIGS. 4A, 6A and 6C, in the case of the muffler 6 with three deflector plates a single exhaust pressure/sound pulse 90 delivered to the inlet 24 can be subdivided by the plurality of internal flow-directing components 40 into a first exhaust pulse 91 traveling through the flowtube 50, a second exhaust pulse 92 traveling along the tortuous passage 46, and four short-cut exhaust pulses 93, 94, 95, 96 traveling through the by-pass passages 48 as they separate from and recombine with (and in the case of shortcut exhaust pulse 93, separate again from) the second interior flow 16. Thus, as provided by the three narrow gaps 74 between the three laterally-offset deflector plates 60 and alternating near sidewalls 36, 38, 36, the three shortcut flows 18 can allow each of the four shortcut exhaust pulses 93, 94, 95, 96 to follow a flowpath of increasing length from the previous exhaust pulse, and with the primary or second exhaust pulse 92 following the longest tortuous flowpath 46 through the wide gaps 70 between the deflector plates 60 and alternating far sidewalls 38, 36, 38.

It is to be appreciated that at any location along the length of the tortuous passage 46 the second interior flow 16 can comprise anywhere from ½ to ¾ of the total volume of the inlet flow 12. The remainder of the inlet flow 12 can be directed either through the substantially-direct passage 44 or through the two or more by-pass passages 48, each of which can comprise anywhere from about ⅕ to about ⅛ of the total volume of the inlet flow 12.

Figure 5:
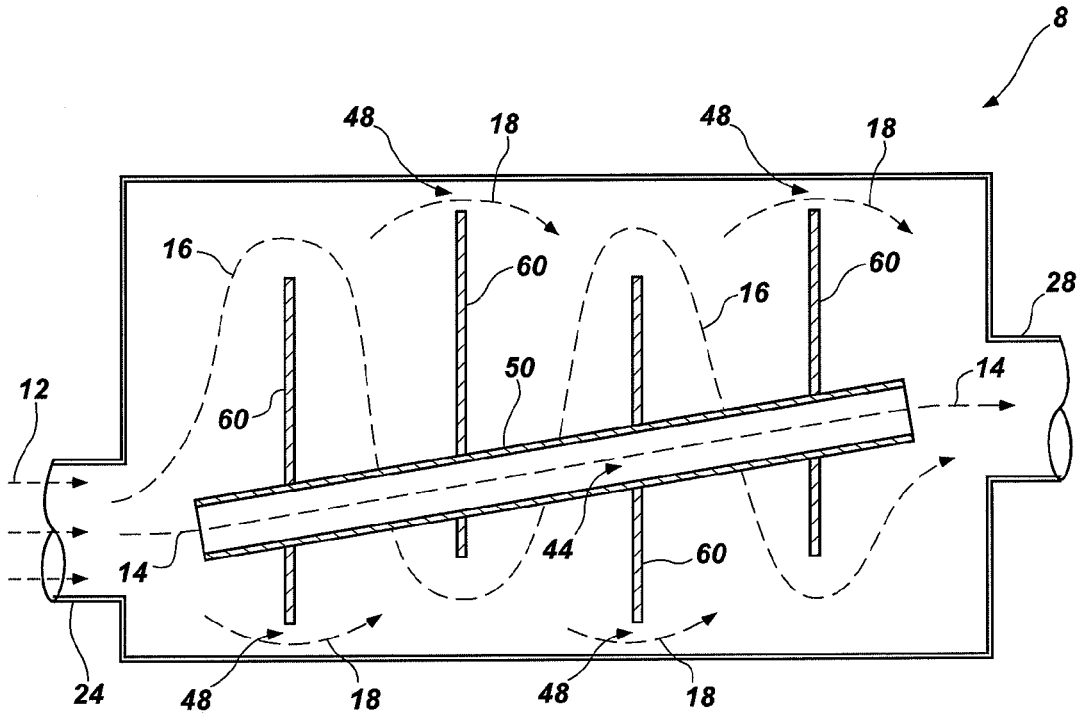
FIG. 5 is a top cross-sectional view of a muffler similar to that of FIG. 1 having four deflector plates, in accordance with another representative embodiment.
Figure 5A:
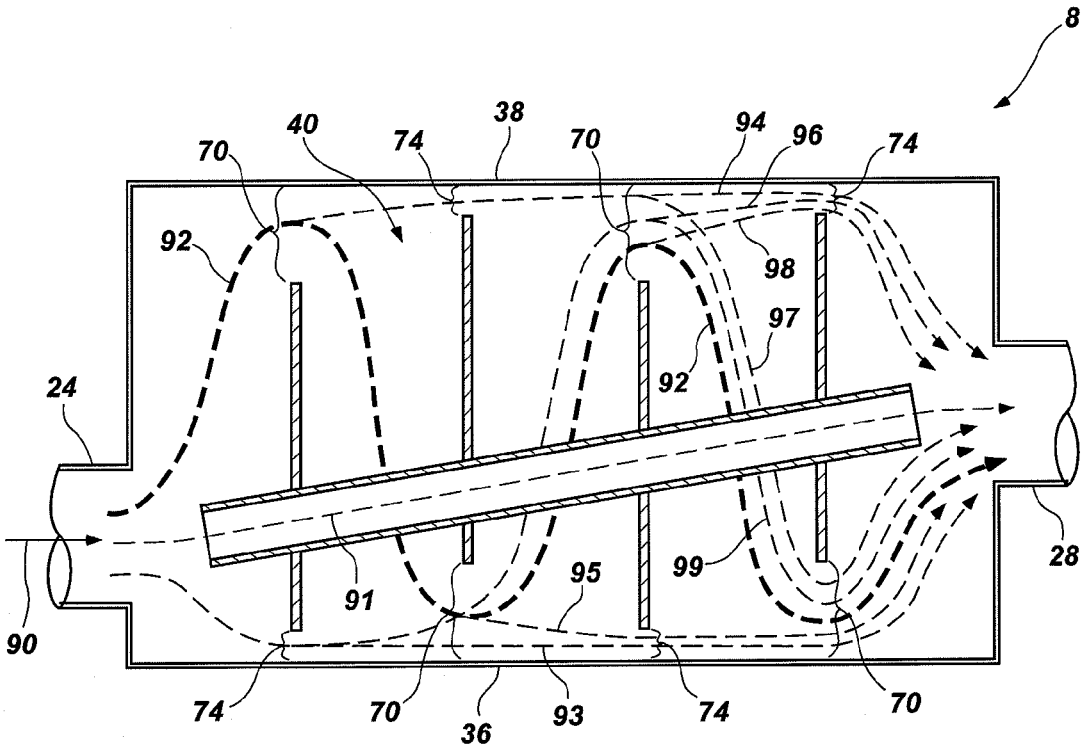
FIG. 5A is a schematic view of the at least nine sound passages of different length provided by the muffler of FIG. 5.

In keeping with the same pattern described above, in one aspect of the sound-modifying muffler 8 shown in FIG. 5, a single flowtube 50 can be supported through four deflector plates 60, forming a plurality of flow-directing components 40 that are configured to provide one substantially-direct passage 44, one tortuous passage 46, and four by-pass passages 48, and which together can subdivide an inlet flow 12 into one first interior flow 14, one second interior flow 16, and four shortcut flows 18, respectively. As further shown FIGS. 5A, 6A and 6D, this can allow for a single exhaust pressure/sound pulse 90 arriving at the inlet 24 of the sound-modifying muffler 8 to be subdivided by the plurality of internal flow-directing components 40 into one first exhaust pulse 91 traveling through the flowtube 50, one second exhaust pulse 92 traveling along the tortuous passage 46, and seven short-cut exhaust pulses 93, 94, 95, 96, 97, 98, 99 traveling through the by-pass passages 48 as they separate from, recombine with (and in the case of shortcut pulses 93, 96 and 97, separate again from) the second exhaust pulse 99. Thus, as provided by the four narrow gaps 74 between the four laterally-offset deflector plates 60 and alternating near sidewalls 36, 38, 36, 38, the three shortcut flows 18 can allow each of the seven shortcut exhaust pulses 93, 94, 95, 96, 97, 98, 99 to follow a flowpath of increasing length from the previous exhaust pulse, and with the primary or second exhaust pulse 92 following the longest tortuous flowpath 46 through the wide gaps 70 between the deflector plates 60 and alternating far sidewalls 38, 36, 38, 36.

As can be seen in FIGS. 6A-6D, a single exhaust pressure/sound pulse 90 being delivered to the inlet 24 of the sound-modifying muffler from the exhaust port of a single cylinder of an internal combustion engine, as shown on FIG. 6A, can be subdivided into a plurality of reduced-pressure outlet exhaust pulses by the plurality of flow-directing components located inside the enclosed case of the muffler. With FIGS. 6B, 6C and 6D corresponding to the different configurations 4, 6, 8 of the sound-modifying muffler described above, respectively, a reduction in the peak sound pressure from the inlet exhaust pulse P1 to the average peak sound pressures P2, P3 and P4 of the reduced-pressure outlet exhaust pulses can be increased by raising the number of flowpaths available to the inlet pulse, for example, from four to six to nine, respectively.

Figure 4A:
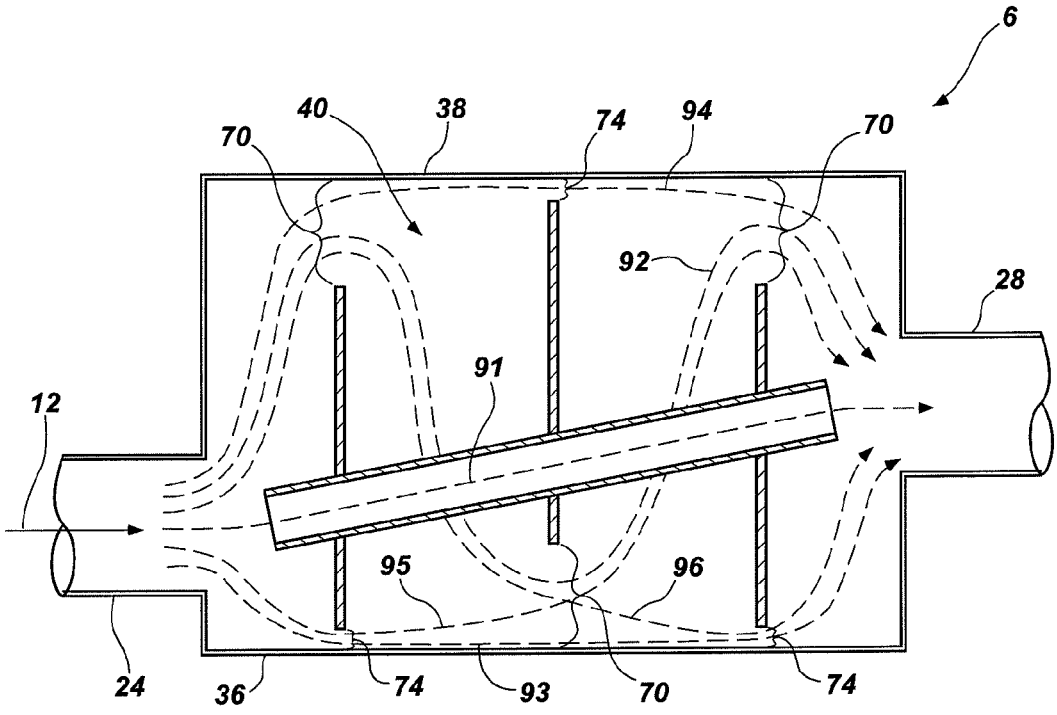
FIG. 4A is a schematic view of the at least six sound passages of different length provided by the muffler of FIG. 4.
Figure 7A:
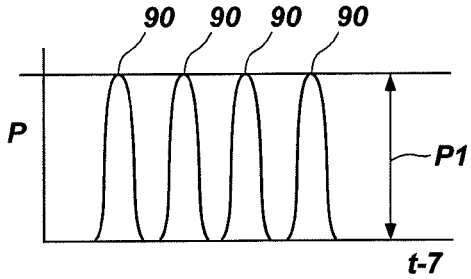
FIGS. 7A-7B together illustrates the breaking up of multiple inlet exhaust pulses into a plurality of reduced-pressure outlet exhaust pulses, as provided by the muffler of FIG. 1.

In one possible application of the sound-modifying muffler illustrated in FIGS. 7A-7B, a representative muffler 6 having a single flowtube supported through three deflector plates, similar to that described with reference to FIGS. 4 and 4A, may be installed into the exhaust system of an automobile having a four stroke, four cylinder internal combustion engine. During operation the engine can provide a plurality of exhaust pressure/sound pulses 90 to the inlet of the sound-modifying muffler at a frequency that is two times the RPM of the engine (FIG. 7A). Each inlet pressure/sound pulse 90 entering the sound-modifying muffler 6 can be subdivided by the plurality of internal flow-directing components into multiple reduced-pressure outlet pulses 91, 92, 93, 94, 95, 96 having an average peak sound pressure P3 that is significantly less than the peak sound pressure P1 of the inlet pulse (FIG. 7B).

Figure 7B:
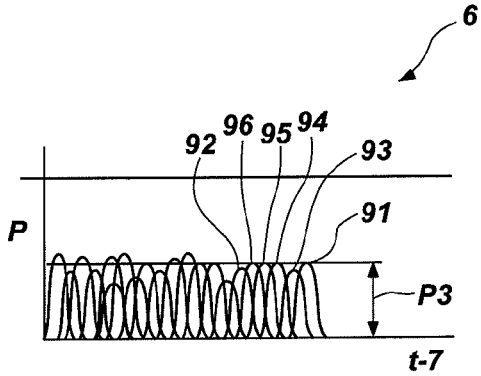

It may also be noted from FIGS. 7A-7B that each subsequent inlet pulse 90 can enter the muffler 6 before all of the previous outlet pulses 92, 95, 96, etc., have had time to travel their respective flowpaths and clear the muffler, so that various outlet pulses created from different inlet pulses can run up onto each other and arrive at the outlet at the same time. Although it is possible for momentary additive affects between pulses to occur at particular engine RPM's and exhaust gas temperatures, it has been discovered that a general smoothing affect is produced which evens out and smoothes the multiple reduced-pressure outlet pulses into a more uniform sound output having both a lower-intensity and higher-frequency than the frequency of the plurality of exhaust pressure/sound pulses 90 entering the inlet of the sound-modifying muffler 6. Thus, subdividing each of a plurality of single inlet pressure/sound pulses 90 into multiple outlet pressure/sound pulses 91-96 can operate to both raise the audible pitch while reducing the intensity of the internal combustion engine's exhaust note. Moreover, this affect can be accomplished across a broad range of engine operating speeds or RPM's, as well as for a wide variety of engines having differing numbers of power cylinders and arrangements.

Furthermore, because increasing the number of flowpaths provided within an enclosed case of substantially-constant size can operate to reduce the average phase spacing between the individual outlet exhaust pulses 91-99, increasing the number of flowpaths within the enclosed case may also cause an additional increase in the average frequency of the reduced-pressure exhaust pulses exiting the muffler.

Figure 8:
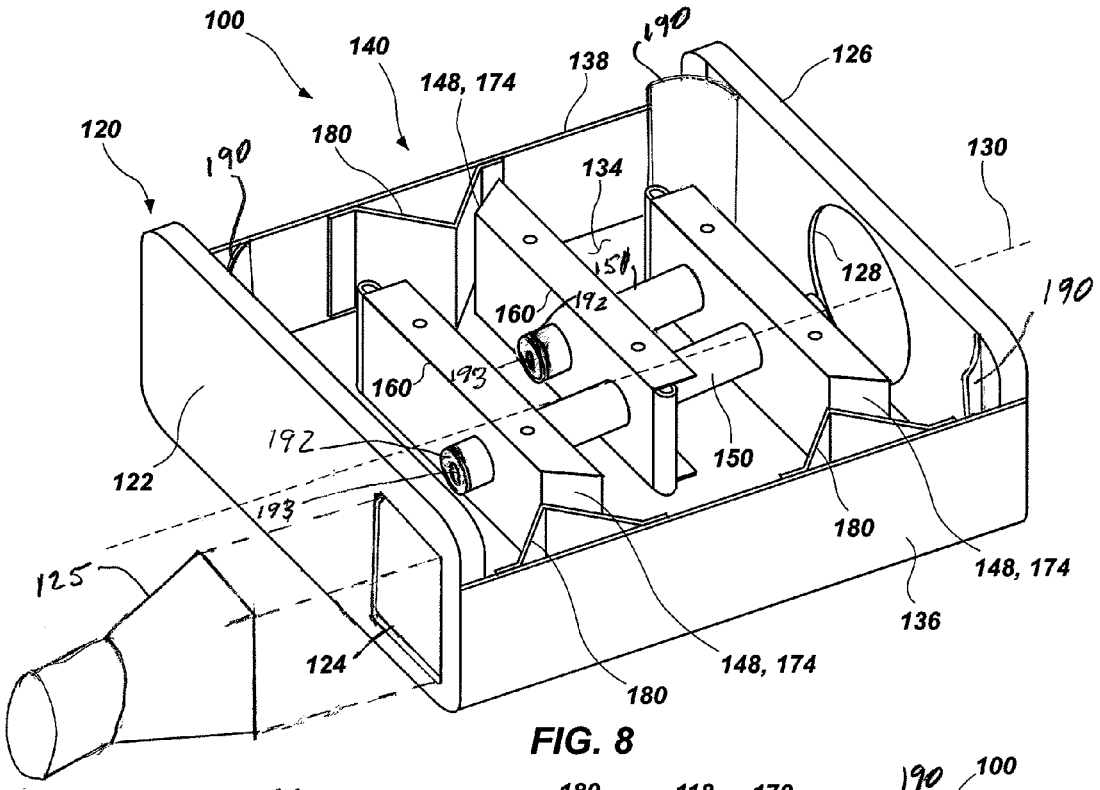
FIG. 8 illustrates a muffler for raising an audible pitch of an internal combustion engine's exhaust note, in accordance with another representative embodiment.
Figure 9:
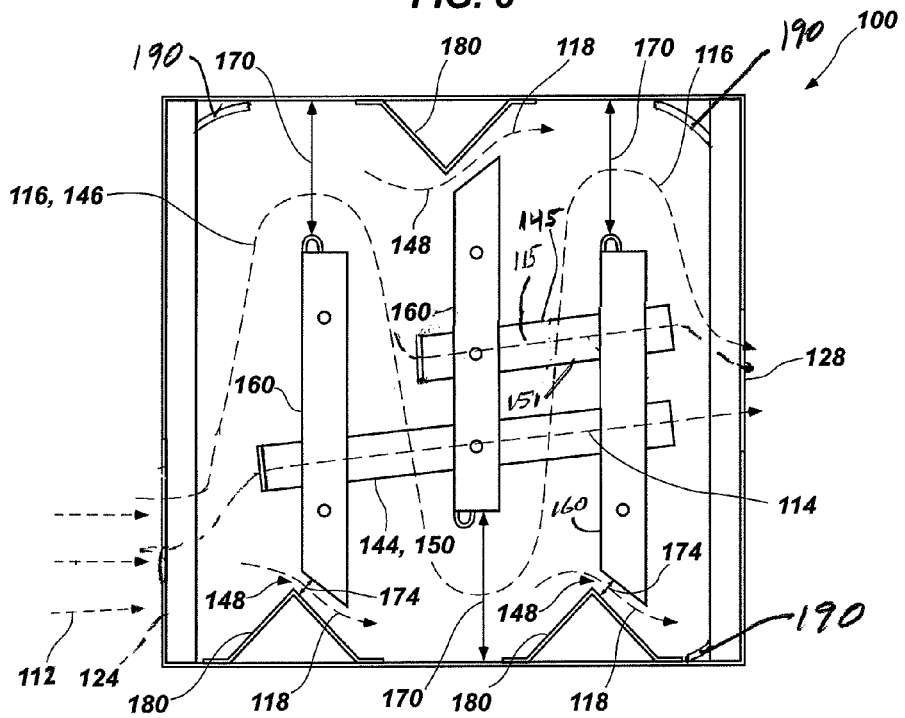
FIG. 9 is a top cross-sectional view of the muffler of FIG. 8, taken along section line 9-9.

Referring now to FIGS. 8 and 9, illustrated therein is another embodiment 100 of the sound-modifying muffler disclosed herein having an enclosed case 120 having an inlet opening 124 in an inlet end 122 and an outlet opening 128 in an outlet end 126, as well as a top (not shown for illustrative purposes), a bottom 134 and two sidewalls 136, 138 surrounding a longitudinal center axis 130. In one aspect the inlet opening 124 can be rectangular rather than round and laterally offset from the longitudinal center axis 130 while the outlet opening 128 can be centered in the outlet end plate 126 and co-axial with the longitudinal center axis 30. Inlet piece 125 can be secured, such as by welding, to inlet opening 124. Inlet piece 125 is adapted to attach to a round exhaust pipe supplying exhaust gas to the muffler and supplies a more vertically evenly distributed flow of exhaust gas into the muffler.

The sound-modifying muffler 100 can include an alternative configuration of flow-directing components 140 located inside the case and adapted to subdivide an inlet flow 112 into a plurality of interior flows, including a first interior flow 114 following a substantially-direct passage 144 between the inlet and outlet openings 124, 128, a second interior flow 116 following a tortuous passage 146 between the inlet and outlet openings having a length at least about twice the length of the substantially-direct passage 144, and three shortcut flows 118 following by-pass passages 148 as they branch or split off from the second interior flow 116 and subsequently recombine with the second interior flow 116 between the inlet and outlet openings 124, 128. In addition, an additional short cut flow passage 115 following a second substantially-direct passage 145 which extends through some, but not all, here shown as the middle and back deflector plates 160, can be provided.

As shown in FIGS. 8-9, the plurality of flow-directing components 140 installed within the enclosed case 120 can include a flowtube 150 extending directly between the inlet opening 124 and the outlet opening 128 to form the substantially-direct passage 144 for the first interior flow 114. The flowtube 150 can be supported by and extend through three deflector plates 160 having a height that spans the distance between the top and the bottom of the enclosed case 120. The additional second substantially-direct passage 145 can be a second flow tube 151 extending through and supported by two of the deflector plates 160.

The three deflector plates 160 can be oriented transverse to the longitudinal center axis 130 of the enclosed case 120, and can have a width that is less than a width of the case, so that neither lateral side edge of the deflector plates contacts a sidewall 136, 138 of the enclosed case. Moreover, each deflector plate 160 of the sound-modifying muffler 100 can be paired with a deflector wedge 180 that projects outwardly from the alternating near sidewalls 136, 138, 136 and into the narrow gaps 174 between the deflector plates and the alternating near sidewalls. Both of the deflector plates 160 and the deflector wedges 180 can be provided with complimentary angled or curved outer surfaces which together form a more aerodynamic configuration of the flow-directing components which can provide both a smoother and more-rounded tortuous passage 146 for the second interior flow 116 and preferentially-angled by-pass passages 148 for the three shortcut flows 118. Also, concavely rounded deflector plates 190 can be provided in the corners of the case 120 to further form a more aerodynamic configuration of the flow-directing components which can provide both a smoother and more-rounded tortuous passage 146 for the second interior flow 116.

Figure 6C:
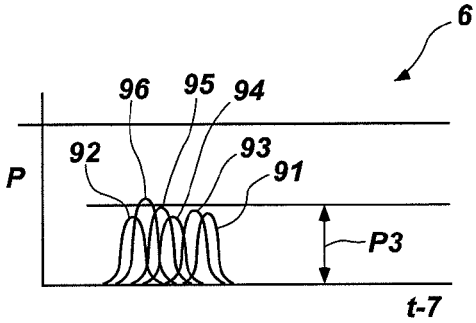
Figure 6D:
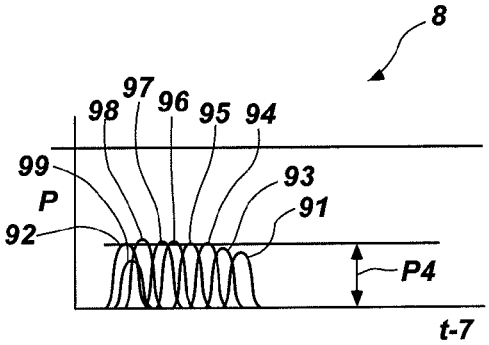

The sound-modifying muffler 100 illustrated in FIGS. 8-9 is shown with three deflector plate 160/deflector wedge 180 pairings which can subdivide a single exhaust pressure/sound pulse 90 delivered to the inlet 124 into a first exhaust pulse 91 traveling through the flowtube 150, a second exhaust pulse 92 traveling along the tortuous passage 146, and four short-cut exhaust pulses 93, 94, 95, 96 traveling through the by-pass passages 148 as they separate from and recombine with (and in the case of shortcut exhaust pulse 93, separate again from) the second interior flow 116 (see also FIGS. 6A and 6C). However, nothing should be construed from the written description as limiting the embodiment 100 depicted in FIGS. 8-9 to the configuration shown, as the sound-modifying muffler can have any number of deflector plate 160/deflector wedge 180 pairings and still remain within the scope of the present invention. Further, the deflector plates can be angled rather than transverse to the longitudinal center axis 130.

Figure 10:
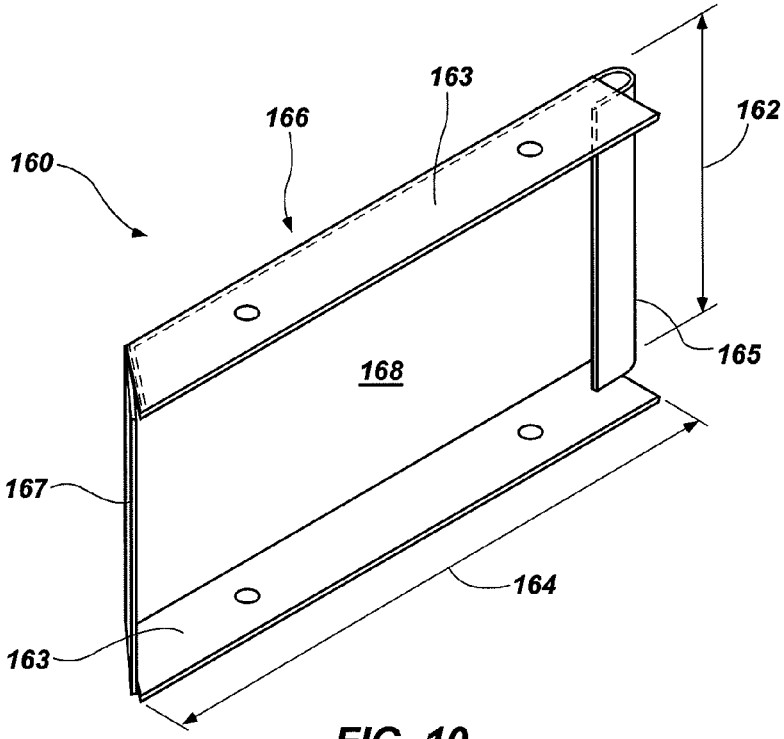
FIG. 10 is a perspective view of a deflector plate, in accordance with the embodiment of FIG. 8.

A more detailed view of a deflector plate 160 constructed in accordance with the sound-modifying muffler embodiment 100 is shown in FIG. 10. In one aspect the deflector plate 160 can comprise a single, flat plate-like element with upper and lower edges which can be folded into flaps 163 for attachment to the top and bottom walls of the enclosed case 120. With the folded flaps the deflector plate can have a height 162 which spans a distanced between the top and bottom of the enclosed case, and a width 164 that is less than a width of the enclosed case. This allows any two adjacent deflector plates 160 to be laterally offset from the longitudinal center axis 130 in opposite directions from each other to establish wide gaps 170 between each deflector plate 160 and alternating far sidewalls (138, 136, 138) and form the tortuous passage 146 for the second interior flow 116. (see also FIGS. 8-9).

Furthermore, the deflector plate's inside lateral side edge 165 which borders the wide gap 170 can also be folded into a rounded shape to facilitate a smooth passage for the second exhaust flow as it is directed across the front face 166 of the deflector plate, through the wide gap 170 and around the inside lateral side edge 165, and back across the back face 168 of the deflector plate. Similarly, the deflector plate's outside lateral edge 167 which borders the narrow gap 174 can be folded into an angle that is complimentary with the angle of the deflector wedge's trailing face, so as to define a by-pass passage having passage walls that are substantially parallel or that expand or contract the passage. As can be seen in FIG. 9, the walls can be angled with respect to the deflector wedge walls so that the by-pass passage formed between the deflector wedge wall and the plate's folded edge wall forms a by-pass passage that expands from a narrower upstream entrance indicated by 174 to a wider downstream end to reduce the pressure of the exhaust gas as it flows through the by-pass. For example, the by-pass passage can expand up to about fifteen degrees.

Figure 11:
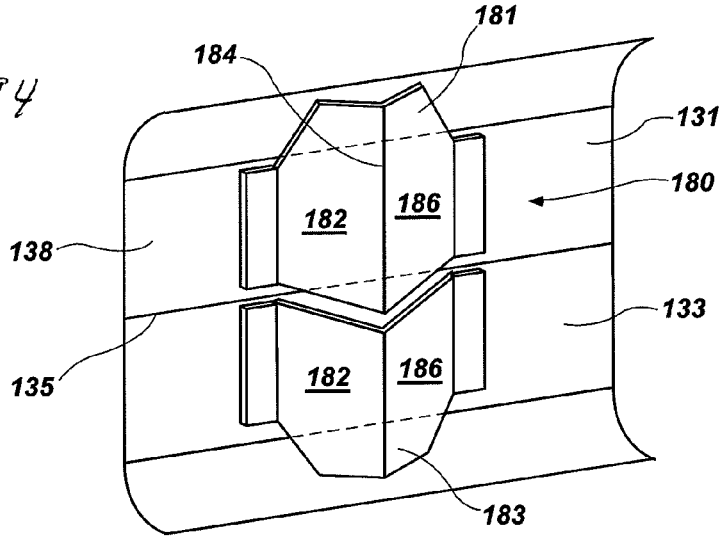
FIG. 11 is a perspective view of a deflector wedge, in accordance with the embodiment of FIG. 8.

A more detailed view of a deflector wedge 180 constructed in accordance with the sound-modifying muffler embodiment 100 is illustrated in FIG. 11. In the aspect shown, the deflector wedge can comprise an upper portion 181 and a lower portion 183 which are attached to a respective upper half 131 and a lower half 133 of the enclosed case that can be joined together along a horizontal joint 135 to form the sidewalls 136, 138. Each upper 181 and lower 183 portion of the deflector wedge 180 can comprise a triangular-shaped structure having an angled leading face 182, an angled trailing face 186, and an apex 184 which can be substantially aligned with the front face of a deflector plate (see FIG. 9). The leading face 182 can project into the tortuous passage to provide an angled surface relative to the near sidewall that can more-readily turn the second interior flow to pass across the deflector plate's front face, while the trailing face can be complimentary with the deflector plate's outside lateral edge to define one side of the by-pass passage for the shortcut flow.

Referring back to FIGS. 8-9, it is to be appreciated that the position of the various flow-directing components 140 installed inside the enclosed case 120 can be adjusted to better control the portion of flow passing through each passage. For instance, the width of the narrow passages 174 between the apexes of the deflector wedges 180 and the deflector plates' outside lateral edge can increase between the deflector plate 160 /deflector wedge 180 pairing nearest the inlet 124 and the pairing nearest the outlet 128 to provide by-pass passages 148 with increasing cross-sectional areas so as to accommodate the expansion of the exhaust gas as it transitions the sound-modifying muffler 100. Similarly, the spacing between adjacent pairings of deflector plates 160/deflector wedges 180 can also be increased from the inlet 124 to the outlet 128, to provided a tortuous passage 146 with increasing cross-sectional area.

Figure 12:
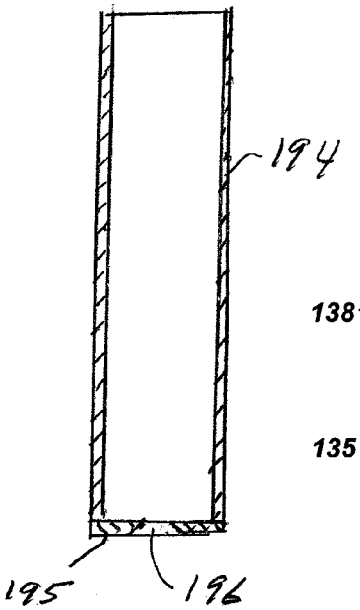
FIG. 12 is a section through a flowtube forming a passage of the invention.

It has been found that the properties of the muffler and the sound produced by the muffler can be further adjusted and tuned by providing reduced diameter entrances to the flowtubes used to produce the substantially direct passages. Such flowtubes are shown in FIGS. 8 and 9, but can be used in any of the embodiments using flowtubes. As shown, flowtube 150 and flowtube 151 have a front end disc 192, similar to a washer, secured thereto, such as by welding, with an entrance opening 193 of smaller diameter than the inside diameter of the flowtube. The entrance 193 can be beveled or straight. FIG. 12 shows such a flowtube 194 in section with front end disc 195 secured thereto. A beveled entrance opening 196 is provided through front disc 195. Various sizes of flowtubes and entrance openings can be used. An example size that can be used is a flowtube 194 of 0.750 inch inside diameter and 0.875 inch outside diameter. Entrance opening 196 can have a small diameter at the small end of the bevel of 0.390 inch with a diameter at the large end of the bevel of 0.400 inch. These are merely examples. The size of the flowtube and size of the entrance, and the relative sizes of both can create various pitch modifications when combined with the other flow paths through the muffler.

Figure 13:
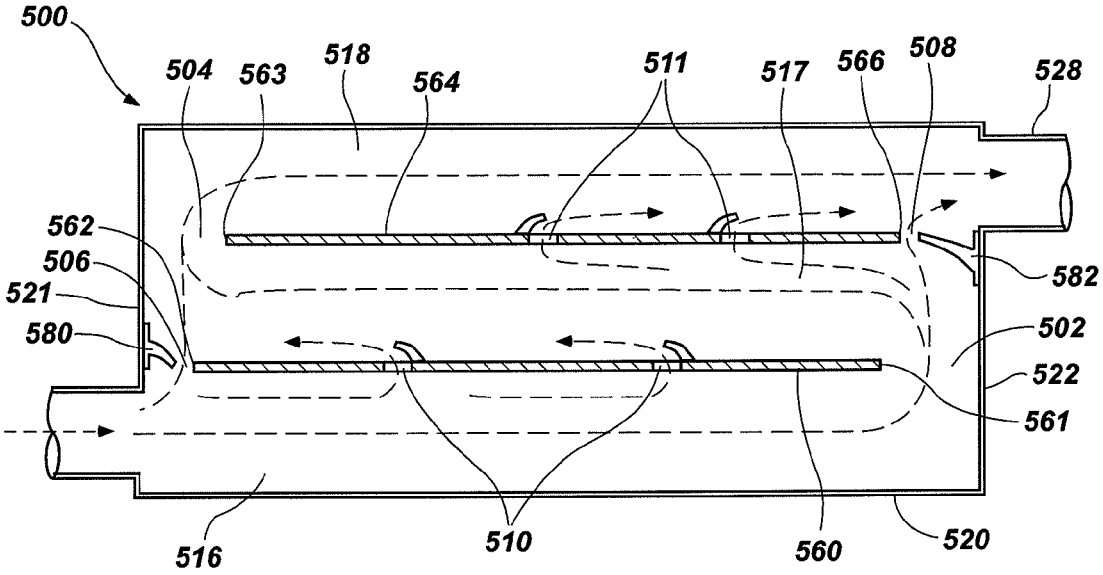
FIG. 13 is a top cross-sectional view of a further representative embodiment of a muffler the invention.

FIG. 13 shows a further embodiment 500 with enclosed case 520 having an inlet 524 through case inlet end wall 521 and an outlet 528 through case outlet end wall 522, and at least one flow-directing component, here including two flow-directing components in the form of elongate plates 560 and 564 forming three parallel passages 516, 517, and 518 within the case along opposite sides of the flow-directing elongate plates 560 and 564, respectively. Passages 516 and 517 are connected through opening 502 between the end 561 of plate 560 and case outlet end wall 522, and passages 517 and 518 are connected through opening 504 between the end 563 of plate 564 and case inlet end wall 521. The flow passage between inlet 524 and outlet 528 formed along the full lengths of the connected parallel passages 516, 517, and 518 provides the flow passage of greatest flow length within the case between the inlet 524 and outlet 528. A deflector wedge 580 is positioned between case inlet wall 521 and end 562 of elongate plate 560 to provide a flow opening 506, and deflector wedge 582 is positioned between case outlet wall 522 and end 566 of elongate plate 564 to provide a flow opening 508. Opening 506 allows some flow from the inlet 524 to flow through opening 506 and space 504 directly to flow passage 518 and along flow passage 518 to outlet 528, bypassing passages 516 and 517, while opening 508 allows some flow from the inlet 524 to flow through passage 516 and openings 502 and 508 directly to outlet 528, bypassing passages 517 and 518. Both of these flows represent the shortest flow length between the inlet 124 and outlet 128, about one third the length of the longest flow length, i.e., the longest flow length is about three times as long as the shortest flow length. Deflector wedge 580 is shaped to direct most flow from inlet 524 into passage 516 and to smooth the corner transitioning passage 517 into opening 504 and deflector wedge 582 is configured to smooth the corner transitioning opening 502 into passage 517 to direct most flow from opening 502 into passage 517. Additional opening 510 are provided extending through plate 560 and additional openings 511 are provided extending through plate 564 allow a plurality of intermediate flow routes through various of these openings 510 and 511 between the inlet and outlet. These intermediate flow routes form a plurality of intermediate passages of varying lengths.

Figure 14:
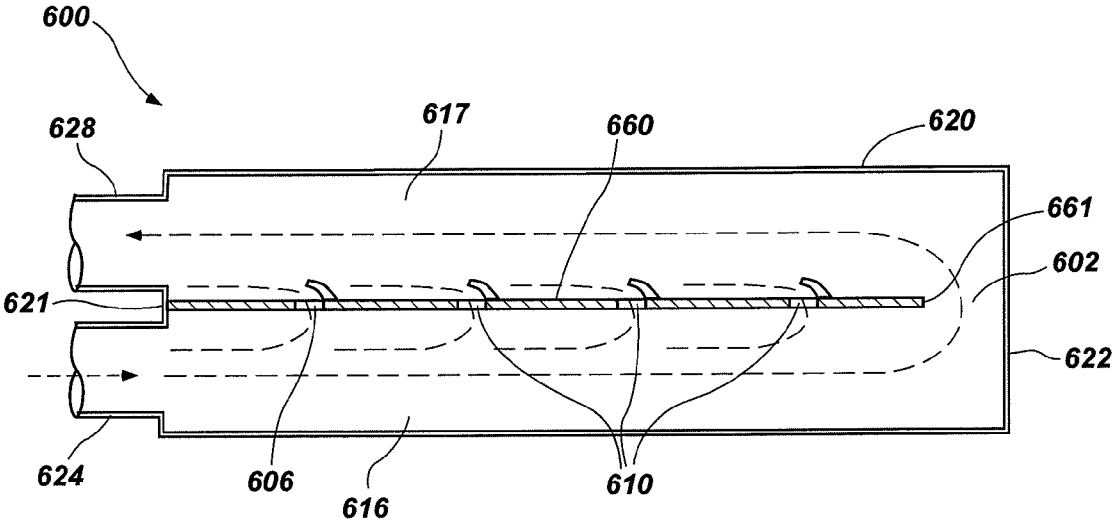
FIG. 14 is a top cross-sectional view of a still further representative embodiment of a muffler the invention.
Figure 15:
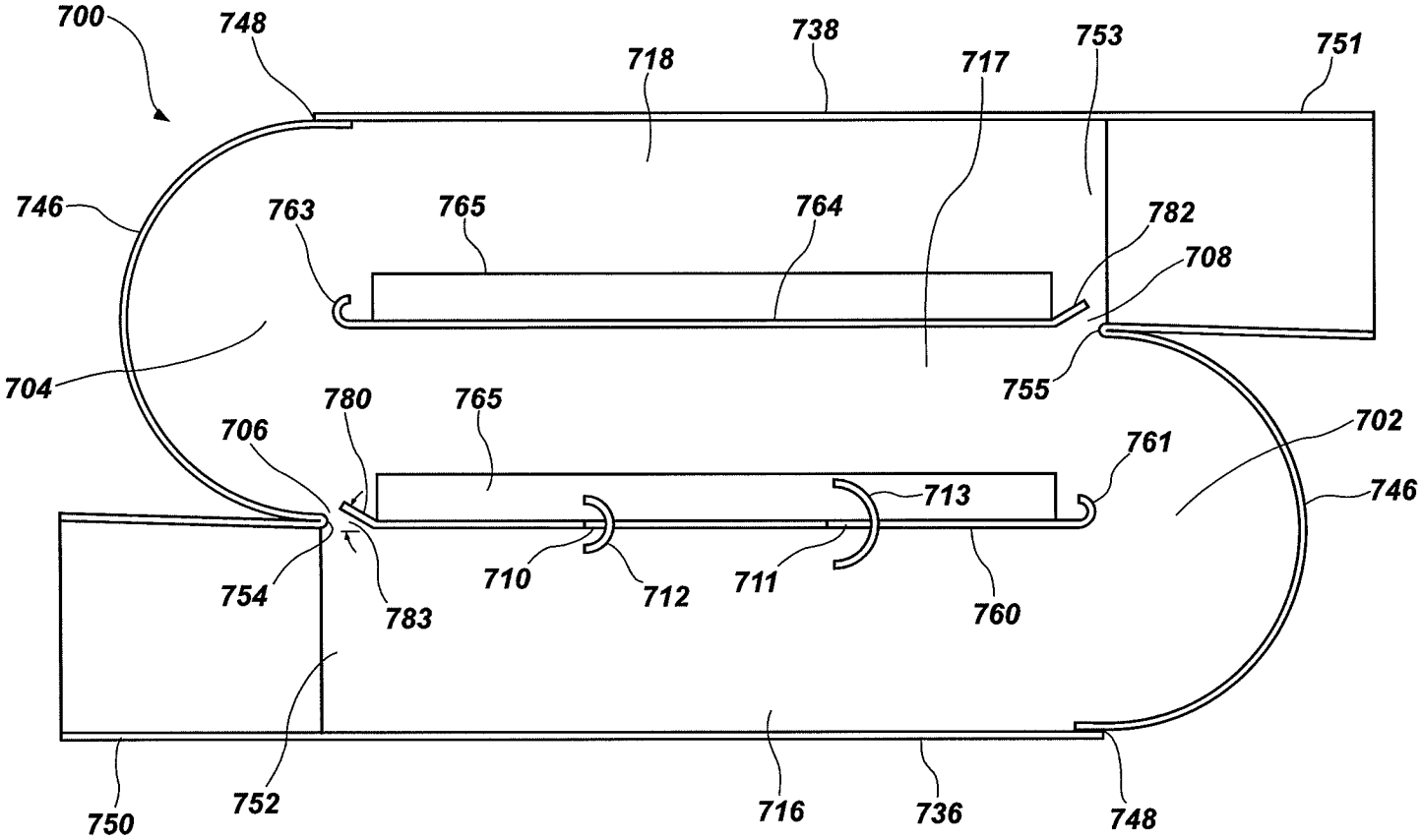
FIG. 15 is a top cross-sectional view of a further representative embodiment of a muffler the invention.
Figure 17:
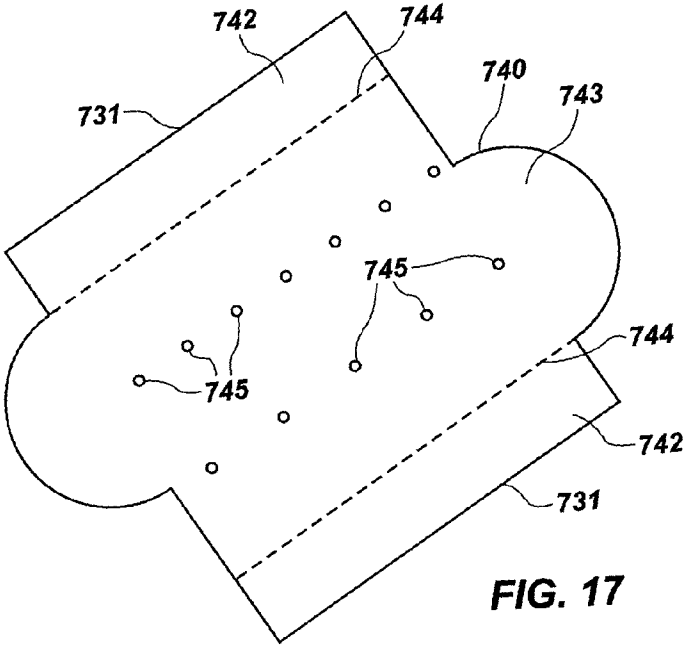
FIG. 17 is a top plan view of a plate used to make the top and bottom halves of the case shown in FIG. 16.
Figure 16:
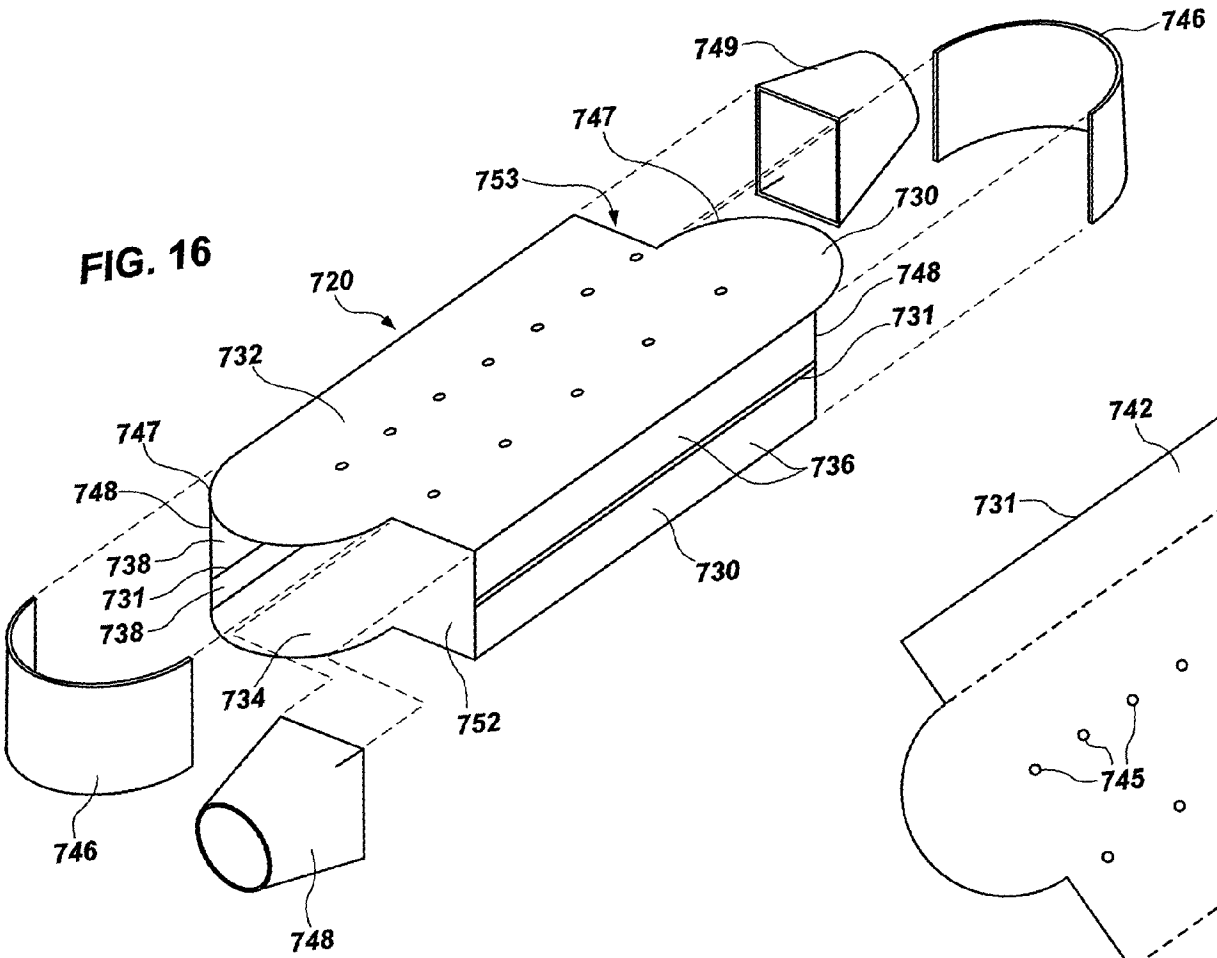
FIG. 16 is a perspective assembly view of the muffler case of FIG. 15.

FIG. 14 shows a still further embodiment 600 with enclosed case 620 having an inlet 624 through case end wall 621 and an outlet 628, also extending through the same case end wall 621. In this embodiment, the inlet and outlet are on the same end 621 of the case 620. The muffler provides a reversal of the direction of exhaust flow from the inlet to the outlet. A flow-directing elongate plate 660 forms parallel passages 616 and 617 within the case along opposite sides of the flow-directing plate 660. Passages 516 and 517 are connected through opening 602 between case end wall 622 the end 661 of plate 660. The flow passage along the full lengths of the connected parallel passages 616 and 617 around the end 661 of plate 660 form the passage with greatest flow length within the case between the inlet 624 and outlet 628. Opening 606 through plate 660 and closest to inlet 624 and outlet 628 allows some flow from the passage 660 to passage 661 through opening 606 without requiring flow all the way around the end 661 of plate 660. This flow passage through opening 606 from passage 616 to passage 617 represents the shortest flow length between the inlet and outlet. Additional openings 610 through plate 660 allow a plurality of intermediate length flow routes between the inlet and outlet which form a plurality of intermediate passages of varying lengths.

Figure 18:
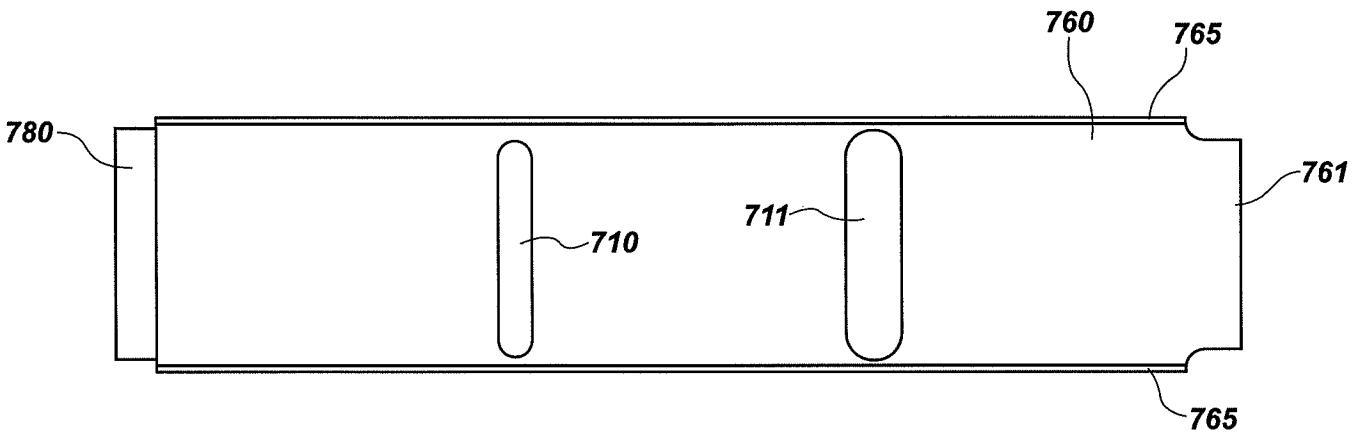
FIG. 18 is a side elevation of an embodiment of a flow directing plate usable in the muffler of FIG. 15.

FIGS. 15-18 show a further embodiment 700 of the sound-modifying muffler similar to the embodiment shown in FIG. 18 including two flow-directing components in the form of elongate plates 760 and 764, FIG. 21, enclosed within a case 720, FIG. 22, to form three parallel passages 716, 717, and 718 within the case 720 along opposite sides of the flow-directing elongate plates 760 and 764, respectively. FIGS. 21-24 illustrate a specific construction of the case and plates that can be used in constructing an embodiment of the invention. As shown by FIG. 22, case 720 may be formed by joining, such as by welding, two case halves 730 along respective case half side edges 731 so that one of the halves forms the case top 732 and the upper portions of the opposite side walls 736 and 738 and the other half forms case bottom 734 and the bottom portions of the opposite side walls 736 and 738. Each case half 730 is identical and can be formed from a sheet of metal 740, FIG. 23, such as by stamping. Opposite sheet side portions 742 are bent at right angles to sheet center portion 743 along bend lines 744 to form a case half 730. Sheet center portion 743 can form a case top or case bottom depending upon whether the half forms a top half or bottom half.

With case halves 730 joined along case half side edges 731 as shown in FIG. 22, elongate plates 760 and 764, not shown in FIG. 22, can be inserted into and secured between case top 732 and case bottom 734. The particular embodiment of elongate plates 760 and 764 as shown in FIGS. 21 and 24 include top and bottom plate flanges 765 which abut the inside surface of the case top 732 and case bottom 734 when placed in the empty case shown in FIG. 22. Rows of holes 745 can be provided through case top 732 and case bottom 734 aligned with the position of plate flanges 765 when the plates 760 and 764 are positioned in the case (plate flanges 765 can also be provided with corresponding holes, not shown) and such holes can be used for initially securing the plates in position with Cleco fasteners, not shown, and then by welding. Other fasteners or methods of fastening plates 760 and 764 in case 720 can be used as appropriate and desired. Further, if desired, plates 760 and 764 can be secured to one of the case halves 730 prior to joining the case halves 730.

With flow directing elongate plates 760 and 764 positioned in assembled case halves 730, arcuate end pieces 746 are secured, such as by welding, to the opposite arcuate end edges 747 of the case top and bottom 732 and 734, respectively and the outside edge 748 of case 720 adjacent the particular arcuate end piece 746. Also, inlet piece 750 and outlet piece 751 are secured, such as by welding, to the inlet opening 752 and outlet opening 753, respectively, of assembled case halves 730. The adjoining edges 754 of inlet piece 750 and adjacent acruate end piece 746 and adjoining edges 755 of outlet piece 751 and adjacent acruate end piece 746 are also secured together, such as by welding. The inlet piece 748 shown is adapted to attach to a round exhaust pipe supplying exhaust gas to the muffler. The outlet piece 749 shown is adapted to attach to a round exhaust tail pipe directing the exhaust gas from the muffler to the atmosphere.

When all pieces are secured as described, a completely closed case, except for the inlet and outlet, is formed with elongate plates 760 and 764 forming the three parallel passages 716, 717, and 718 within the case along opposite sides of the flow-directing elongate plates 760 and 764, respectively. Passages 716 and 717 are connected through relatively wide opening or gap 702 between rounded end 761 of plate 760 and adjacent case arcuate end piece 746. Arcuate end piece 746 directs and smooths the flow of gas from flow passage 716 to flow passage 717. Passages 717 and 718 are connected through relatively wide opening or gap 704 between rounded end 763 of plate 764 and adjacent case arcuate end piece 746. Arcuate end piece 746 directs and smooths the flow of gas from flow passage 717 to flow passage 718. The discrete flow passage between inlet 752 and outlet 753 formed along the full lengths of the connected parallel passages 716, 717, and 718 provides the discrete flow passage of greatest flow length within the case between the inlet 752 and outlet 753. A deflector flange 780 extends from the end of plate 760 opposite rounded end 761 and forms a relatively narrow (compared to opening 702) flow opening or gap 706 between plate 760 and the end portion of the case formed by the adjoining edges 754 of inlet piece 750 and adjacent acruate end piece 746. A deflector flange 782 extends from the end of plate 764 opposite rounded end 763 and forms a relatively narrow flow opening or gap 708 between plate 764 and the end portion of the case formed by the adjoining edges 755 of outlet piece 751 and adjacent acruate end piece 746. Flow opening 706 allows some flow from the inlet 752 to flow through opening 706 and opening 704 directly to flow passage 718 and along flow passage 718 to outlet 753, by-passing passages 716 and 717, while flow opening 708 allows some flow from the inlet 752 to flow through passage 716 and openings 702 and 708 directly to outlet 753, bypassing passages 717 and 718. Both of these discrete flow passages represent the shortest flow length between the inlet 752 and outlet 754, about one third the length of the longest flow length, i.e., the longest flow length is about three times as long as the shortest flow length. Deflector flange 780 is positioned to apportion flow from inlet 752 between passage 716 and opening 706 and deflector flange 782 is configured to apportion flow from opening 702 between passage 717 and opening 708. It has been found that deflector flanges 780 and 782 extending at angles 783, FIG. 21, of about thirty degrees from the elongate faces of plates 760 and 764 provide satisfactory flow control, although other angles may be used. Additional openings 710 and 711 through plate 760 provide discrete intermediate flow routes through these openings between flow passages 716 and 717 to thereby provide discrete intermediate flow passages between the inlet 752 and outlet 753. The length of each of these discrete intermediate flow passages is between the shortest flow passage and the longest flow passage. Similar openings may be provided through plate 764, if desired, to provide additional discrete intermediate flow routes. As shown in FIGS. 21 and 24, openings 710 and 711 may be of different sizes and may include flow deflectors 712 and 713 to direct different intermediate flows between flow passages 716 and 717. For example, opening 710 may take the form of about a three-eights inch slot with an arcuate deflector 712 having an inside radius of between about one-quarter and five-sixteenths inch and opening 711 may take the form of about a five-eights inch slot with an arcuate deflector 713 having an inside radius of between about one-half and nine-sixteenths inch. Various other size openings and deflectors may be used, and more than the two openings shown may be provided. These intermediate flow routes form a plurality of discrete intermediate flow passages of varying discrete lengths.

It should be noted that with all of the embodiments shown the relative lengths of the various flow passages, amount of flow through the various flow passages, and the size of the various openings and deflectors will all affect the frequency modification produced by the muffler and the exhaust sound provided by the muffler. Further, as can be seen for all of the embodiments, all gas flow through the muffler will be through the various discrete flow passages provided in the muffler.

Figure 19:
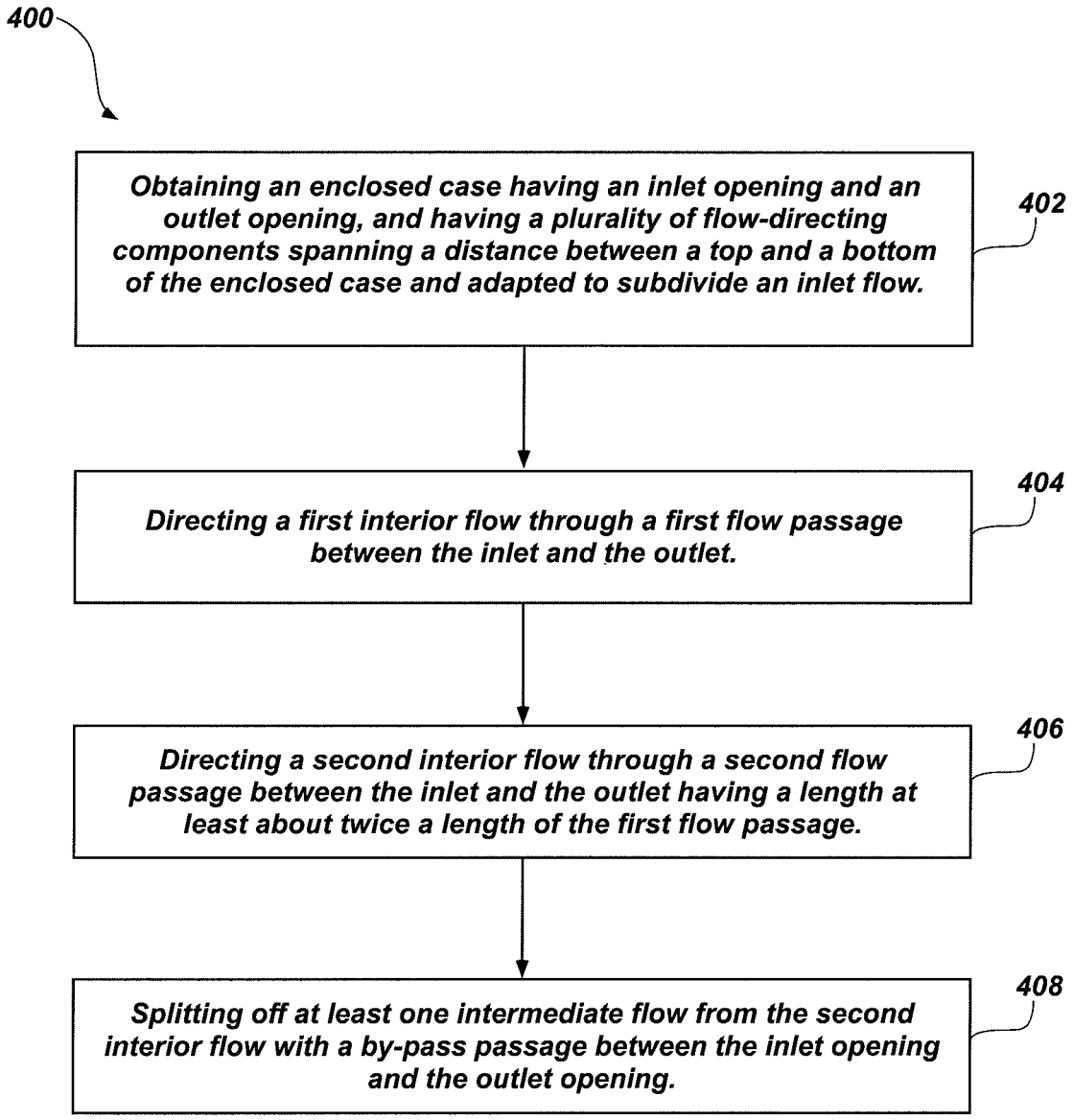
FIG. 19 is a flowchart depicting a method for raising an audible pitch of an internal combustion engine's exhaust note, in accordance with one representative embodiment.

FIG. 19 is a flowchart depicting a method 400 for raising an audible pitch of an internal combustion engine's exhaust note, in accordance with one representative embodiment. The method 400 can includes the steps of obtaining 402 an enclosed case having an inlet and an outlet and having a plurality of flow-directing components adapted to subdivide an inlet flow, and directing 404 a first interior flow through a first passage of shortest flow length between the inlet and the outlet. The method further includes directing 406 a second interior flow through a tortuous passage between the inlet and the outlet having a length at least about twice the length of the first passage, and splitting off 408 at least one intermediate flow from the second interior flow with at least one by-pass passage between the inlet and the outlet.

The foregoing detailed description describes the invention with reference to specific representative embodiments. However, it will be appreciated that various modifications and changes can be made without departing from the scope of the present invention as set forth in the appended claims. The detailed description and accompanying drawings are to be regarded as illustrative, rather than restrictive, and any such modifications or changes are intended to fall within the scope of the present invention as described and set forth herein.

More specifically, while illustrative representative embodiments of the invention have been described herein, the present invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, any steps recited in any method or process claims, furthermore, may be executed in any order and are not limited to the order presented in the claims. The term "preferably" is also non-exclusive where it is intended to mean "preferably, but not limited to." Accordingly, the scope of the invention should be determined solely by the appended claims and their legal equivalents, rather than by the descriptions and examples given above.

The invention claimed is:

1. A muffler for raising an audible pitch of an internal combustion engine's exhaust note, comprising:

an enclosed case having an inlet and an outlet; and a plurality of flow-directing components adapted to subdivide an inlet flow into a plurality of interior flows comprising:

a flowtube extending between the inlet and the outlet to form a first substantially-direct interior flow passage providing the shortest flow length through the enclosed case between the inlet and the outlet, said flowtube having an inside diameter and having an entrance end with an entrance opening having a diameter smaller than the inside diameter of the flowtube; and at least two deflector plates spanning a distance between a top and a bottom of the enclosed case and oriented transverse to a longitudinal center axis of the case, and supporting the flowtube therethrough, wherein adjacent deflector plates are laterally offset from a longitudinal center axis in opposite directions with wide gaps between each deflector plate and alternating far sidewalls forming a tortuous passage providing a second interior flow passage between the inlet and the outlet and having a flow length at least about twice the flow length of the first interior flow passage, and wherein narrow gaps between each deflector plate and alternating near sidewalls form by-pass shortcut flow passages to provide at least one intermediate interior flow passage which splits off from the second interior flow passage between the inlet and the outlet, and wherein at least one of the at least one intermediate flow passage recombines with the second interior flow passage between the inlet and the outlet.

2. The muffler of claim 1, wherein the flow-directing components further comprise at least one deflector wedge extending into a narrow gap from a near sidewall to further define at least one by-pass passage.

3. The muffler of claim 1, wherein a width of the narrow gaps increases from the inlet to the outlet to provided by-pass passages with increasing cross-sectional areas.

4. The muffler of claim 1, wherein a spacing between the at least two deflector plates increases from the inlet to the outlet to provided a tortuous passage with increasing cross-sectional area.

5. The muffler of claim 1, wherein the inlet and a first deflector plate proximate the inlet are offset laterally from the longitudinal center axis in the same direction.

6. The muffler of claim 1, wherein each of the at least two deflector plates further comprise at least one rounded side edge defining a wide gap for smoothing the second interior flow passage.

7. A muffler for raising an audible pitch of an internal combustion engine's exhaust note, comprising:

an enclosed case having an inlet in an inlet end and an outlet in an outlet end; and a plurality of flow-directing components spanning a distance between a top and a bottom of the enclosed case and adapted to subdivide an inlet flow into a plurality of interior flows, the flow-directing components comprising:

a flowtube extending between the inlet and the outlet to form a substantially-direct passage for a first interior flow, said flowtube having an inside diameter and having an entrance end with an entrance opening having a diameter smaller than the inside diameter of the flowtube; and at least two deflector plates oriented transverse to a longitudinal center axis of the case and supporting the flowtube therethrough, wherein adjacent deflector plates are laterally offset from the longitudinal center axis in opposite directions with wide gaps between each deflector plate and alternating far sidewalls forming a tortuous passage between the inlet and the outlet for a second interior flow having a length at least about twice a length of the substantially-direct passage, and wherein narrow gaps between the deflector plates and alternating near sidewalls form at least one by-pass passage for a shortcut flow splitting off from and recombining with the second interior flow between the inlet and the outlet.

* * * * *